US005334494A

United States Patent [19]

Ueda et al.

[11] Patent Number: 5,334,494

[45] Date of Patent: Aug. 2, 1994

[54] SILVER HALIDE PHOTOGRAPHIC LIGHT-SENSITIVE MATERIAL

[75] Inventors: Eiichi Ueda; Fumie Fukazawa; Toshihiko Yagi, all of Hino, Japan

[73] Assignee: Konica Corporation, Tokyo, Japan

[21] Appl. No.: 153,472

[22] Filed: Nov. 15, 1993

Related U.S. Application Data

[63] Continuation of Ser. No. 893,649, Jun. 4, 1992, abandoned.

[30] Foreign Application Priority Data

Jun. 12, 1991 [JP] Japan ..... 3-167570

[51] Int. Cl.[5] ..... G03C 1/76

[52] U.S. Cl. ..... 430/533; 430/523; 430/539; 430/930

[58] Field of Search ..... 430/533, 539, 523, 930

[56] References Cited

FOREIGN PATENT DOCUMENTS 253534 1/1988 European Pat. Off. ..... G03C 1/31
334367 9/1989 European Pat. Off. ..... G03C 1/76
360616 3/1990 European Pat. Off. ..... G03C 1/81

*Primary Examiner*—Jack P. Brammer
*Attorney, Agent, or Firm*—Jordan B. Bierman

[57] ABSTRACT

A silver halide photographic light-sensitive material, having provided at least one silver halide emulsion layer on a support and a back coating layer on the other side thereof, wherein the support has a loss modules at 50°C. of 0.03 or more, is disclosed. The back coating layer has a gelatin content of 6 g/m$^2$ or less, and the ratio of the gelatin content of the back coating layer to that of the emulsion layer was 0.3 or more.

11 Claims, No Drawings

SILVER HALIDE PHOTOGRAPHIC LIGHT-SENSITIVE MATERIAL

This application is a continuation of application Ser. No. 07/893,649, filed Jun. 4, 1992, now abandoned.

FIELD OF THE INVENTION

The present invention relates to a silver halide photographic light-sensitive material, more specifically to a silver halide photographic light-sensitive material which can be straightened out readily when unrolled and hardly curls up, and hence, is free of troubles caused by curling.

BACKGROUND OF THE INVENTION

Various substances have heretofore been employed as the support of a silver halide photographic light-sensitive material. Representative supports include triacetyl cellulose films and films of a polyester such as polyethylene terephthalate. Substances to be used as a support must have a sufficient mechanical strength, and must be able to be straightened out readily when unrolled after storage in the form of a roll. In addition, a support is required to have a higher resistance to curling. Curling of a support prevents the light-sensitive material from being loaded properly in a camera, hindering smooth winding of the light-sensitive material. (The ability of being loaded properly in a camera will be referred to as "camera loading suitability". )

Meanwhile, there has been an increasing demand for a camera which is compact but adaptable to a large number of exposures . In particular, a throwaway camera (a photographic film with a shutter and a lens provided) has come to be used widely since it is compact and easy to operate . A light-sensitive material for use in this type of camera is required to have a reduced total thickness, which can be attained by decreasing the thickness of a support . In the case of conventional triacetyl cellulose films, however, a reduction in thickness results in insufficient mechanical strength. Polyester films can exhibit a high mechanical strength even with a reduced thickness, but they have such defects that they cannot be straightened out readily when unrolled and they are poor in resistance to curling.

As is apparent from the above, conventional supports are disadvantageous in respect of strength, resistance to curling, and camera loading suitability.

SUMMARY OF THE INVENTION

The object of the invention is to provide a silver halide photographic light-sensitive material for a color film being used for cameras which is tough and thin, and hence, can realize a large number of exposures with a small-sized camera, and at the same time, improved in resistance to curling and camera loading suitability.

The above object can be attained by a silver halide color photographic light-sensitive material comprising a support, at least one silver halide emulsion layer provided on one side of the support, and a back coating layer provided on the other side of the support, wherein said support has a loss modulus of 0.03 or more at 50° C; said back coating layer has a gelatin content of 6 g/m$^2$ or less; and the ratio of the gelatin content of said back coating layer to that of said silver halide emulsion layer(s) is 0.3 or more.

By the invention, the above-mentioned problems can be completely solved.

A support with a loss modulus (tan δ) of 0.03 or more can be straightened out readily when unrolled after storage in the form of a roll, but tends to curl up greatly. Especially when the total thickness of a light-sensitive material is reduced, curling of a support will prevent the light-sensitive material from being wound smoothly in a camera. Curling can be eliminated to some extent by increasing the amount of gelatin in a back coating layer. However, the use of a large amount of gelatin results in an increase in the total thickness of a light-sensitive material.

Loss modulus as referred to herein (tan δ) is defined by the following equation:

$$\tan \delta = E'/E''$$

wherein E'' is loss modulus and E'' is storage modulus.

E'' and E'' can be measured by using RHEO VIBRON DDV-II-EA (manufactured by Toyo Boldwin) and a sample with a thickness of 75 μm, a length of 20 mm and a width of 2 mm. The measurement conditions are: oscillation frequency, 11 hz, dynamic displacement, ±16 μm, temperature, 50° C.

The support of the light-sensitive material of the invention should preferably be composed of a copolyester that contains an aromatic dibasic acid (in particular, terephthalic acid) and glycol as the main components, and has physical properties specified in the invention.

An aromatic dicarboxylic acid containing a metal salt of sulfonic acid and polyethylene glycol are preferable as the components to be copolymerized with the terephthalic acid component and the glycol component. A copolymer of them is especially preferable. Examples of an aromatic dicarboxylic acid containing a metal salt of sulfonic acid include 5-sodium sulfoisophthalate, 2-sodium sulfoterephthalate, 6-naphthalene dicarboxylate, compounds obtained by substituting the sodium of the preceding compounds with other metals such as potassium and lithium, and esters of these compounds. 5-sodium sulfoisophthalate is preferably selected as the metal salt of sulfonic acid. As a polyethylene glycol, one with 2-500 (still preferably 50-150) ethylene glycol repeating units is preferable. Isophthalic acid or its esters are also usable as the acid component. Propylene glycol, butane diol, neopentyl glycol, 1,4-cyclohexane diol and diethylene glycol may also be contained as the alcohol component.

The support of the light-sensitive material of the invention can be obtained by a process that comprises: drying a resin; subjecting the resin to melt extrusion to form an unstretched film; and subjecting the film to stretching in longitudinal and lateral directions, as well as to heat fixation, thereby to obtain a film in a desired shape. Stretching should normally be performed at 50–140° C. and with a stretch ratio of 2 to 5. Heat fixation temperature is not limitative, but preferably 150–220° C.

When the support of the light-sensitive material of the invention consists of a polyester resin, it is preferable to add a dye thereto to prevent light piping. There is no restriction as to the type of a dye, but a gray dye which is resistant to heat generated during film-forming process is preferable. Usable dyes include Diaresin (manufactured by Mitsubishi Chemical Co., Ltd.), Kayaset (manufactured by Nippon Kasei Co., Ltd.), a dye described in U.S. Pat. No. 3,822,132, or a mixture thereof.

In the light-sensitive material of the present invention, at least one silver halide emulsion layer is provided on the support. Conventional silver halide emulsions may be employed for forming the silver halide emulsion layers.

The silver halide light-sensitive material of the invention hardly curls up, and therefore, have improved camera loading suitability, and can be straightened out readily when unrolled after storage in the form of a roll. These advantages can be maintained even when the total thickness of the light-sensitive material is reduced.

EXAMPLES

The present invention will be described in more detail according to the following examples .

EXAMPLE 1

Preparation of Light-Sensitive Material (Support)

Support 1 . Polyethylene terephthalate film (75 μm)
Longitudinal stretching:
Temperature, 90° C.
Stretch ratio, 3
Lateral stretching:
Temperature, 90° C.
Stretch ratio, 3
Heat fixation:
Temperature, 220° C.

Support 2 . A copolymer of dimethyl terephthalate, 5-sodium dimethylsulfoisophthalate and ethylene glycol (thickness: 75 μm, molar ratio: 95:5:100)
Longitudinal stretching:
Temperature, 110° C.
Stretch ratio, 3
Lateral stretching:
Temperature, 1i0° C.
Stretch ratio, 3
Heat fixation:
Temperature, 200° C.

Support 3: A copolymer of dimethyl terephthalate, 5-sodium dimethylsulfoisophthalate, polyethylene glycol (molecular weight: 3500) and ethylene glycol (thickness: 75 μn, molar ratio: 95:5:0.5:99.5)
Longitudinal stretching:
Temperature, 80° C.
Stretch ratio, 3
Lateral stretching:
Temperature, 80° C.
Stretch ratio, 3
Heat fixation:
Temperature, 200° C.

Support 4: A copolymer of dimethyl terephthalate, 5-sodium dimethylsulfoisophthalate, polyethylene glycol (molecular weight: 5000) and ethylene glycol (thickness: 75 μm, molar ratio: 95:5:0.5:99.7)
Longitudinal stretching:
Temperature, 85° C.
Stretch ratio, 3
Lateral stretching:
Temperature, 85° C.
Stretch ratio, 3
Heat fixation:
Temperature, 200° C.

(Sample 101)

The both sides of support 1 was subjected to corona discharge treatment [8W/(m$^2$ min)]. On one side of the support, a back coating liquid of the following composition (coating liquid B-3) was applied, thereby to obtain a back coating layer (layer B-3) with a dry thickness of 0.8 μm. On the other side of the support, another back coating liquid of the following composition (coating liquid B-4) was applied, thereby to obtain another back coating layer (layer B-4) with a dry thickness of 0.8 μm.

| Coating liquid B-3 | |
|---|---|
| A latex of a copolymer comprising 30 wt % butyl acrylate, 20 wt % t-butyl acrylate, 25 wt % styrene and 25 wt % 2-hydroxyethyl acrylate (solid content: 30%) | 270 g |
| Compound C-6 | 0.6 g |
| Hexamethylene-1,6-bis(ethyleneurea) | 0.8 g |

Water was added to make the total thickness 1 1.

| Coating liquid B-4 | |
|---|---|
| A latex of a copolymer comprising 40 wt % butyl acrylate, 20 wt % styrene and 40 wt % glycidyl acrylate (solid content: 30%) | 270 g |
| Compound C-6 | 0.6 g |
| Hexamethylene-1,6-bis(ethyleneurea) | 0.8 g |

Water was added to make the total thickness 1 1.

Both of the back coating layers were subjected to corona discharge treatment [8W/(m$^2$ min)]. Then, on layer B-3, the following coating liquid B-5 was applied to form a layer (back coating layer B-5) with a dry thickness of 0.1 μm. On layer B-4, the following coating liquid B-6 was applied to form a layer (back coating layer B-6) with a dry thickness of 0.8 μm.

| Coating liquid B-5 | |
|---|---|
| Gelatin | 10 g |
| Compound C-6 | 0.2 g |
| Compound C-7 | 0.2 g |
| Compound C-8 | 0.1 g |
| Silica particles (average particle size: 3 μum) | 0.1 g |

Water was added to make the total quantity 1 1.

| Coating liquid B-6 | |
|---|---|
| Water-soluble conductive polymer C-9 | 60 g |
| A latex comprising compound C-10 (solid content: 20%) | 80 g |
| Ammonium sulfate | 0.5 g |
| Hardener (C-11) | 12 g |
| Polyethylene glycol (weight average molecular weight: 600) | 6 g |

Water was added to make the total quantity 1 1.

The structures of the compounds employed will be shown later.

Back coating layers B-5 and B--6 were each subjected to corona discharge treatment [25W/(m$^2$ min) for layer B-D, 8W/(m$^2$ min) for layer B-6].

On layer B-6, the following back coating layer was provided, and on layer B-5, the following emulsion layers and auxiliary layers were provided in sequence from the support, whereby a multilayer color photographic light-sensitive material was obtained.

| | |
|---|---|
| Back coating layer | |
| Gelatin | 4.0 g |
| Merck saponin | 2.0 mg |
| Silica particles (average particle size: 3 μm) | 20 mg |
| Colloidal silica | 60 mg |
| Compound C-8 | 10 mg |
| Compound H-1 | 15 mg |
| Compound VS-2 | 20 mg |
| Emulsion layer | |
| 1st layer: Anti-halation layer (HC) | |
| Black colloidal silver | 0.15 g |
| UV absorber (UV-1) | 0.20 g |
| Compound CC-1 | 0.02 g |
| High-boiling solvent (Oil 1) | 0.20 g |
| High-boiling solvent (Oil 2) | 0.20 g |
| Gelatin | 1.6 g |
| 2nd layer: Intermediate layer (IL-1) | |
| Gelatin | 1.3 g |
| 3rd layer: Low-speed red-sensitive emulsion layer (R-L) | |
| Silver iodobromide emulsion (average grain size: 0.3 μm, average iodine content: 2.0 mol %) | 0.4 g |
| Silver iodobromide emulsion (average grain size: 0.4 μm, average iodine content: 8.0 mol %) | 0.3 g |
| Sensitizing dye (S-1) | $3.2 \times 10^{-4}$ mol per mol silver |
| Sensitizing dye (S-2) | $3.2 \times 10^{-4}$ mol per mol silver |
| Sensitizing dye (S-3) | $0.2 \times 10^{-4}$ mol per mol silver |
| Cyan coupler (C-1) | 0.50 g |
| Cyan coupler (C-2) | 0.13 g |
| Colored cyan coupler (CC-1) | 0.07 g |
| DIR compound (D-1) | 0.006 g |
| DIR compound (D-2) | 0.01 g |
| High-boiling solvent (Oil-1) | 0.55 g |
| Gelatin | 1.0 g |
| 4th layer: High-speed red-sensitive emulsion layer (R-H) | |
| Silver iodobromide emulsion (average grain size: 0.7 μm, average iodine content: 7.5 mol %) | 0.9 g |
| Sensitizing dye (S-1) | $1.7 \times 10^{-4}$ mol per mol silver |
| Sensitizing dye (S-2) | $1.6 \times 10^{-4}$ mol per mol silver |
| Sensitizing dye (S-3) | $0.1 \times 10^{-4}$ mol per mol silver |
| Cyan coupler (C-2) | 0.23 g |
| Colored cyan coupler (CC-1) | 0.03 g |
| DIR compound (D-2) | 0.02 g |
| High-boiling solvent (Oil-1) | 0.25 g |
| Gelatin | 1.0 g |
| 5th layer: Intermediate layer (IL-2) | |
| Gelatin | 0.8 g |
| 6th layer: Low-speed green-sensitive emulsion layer (G-L) | |
| Silver iodobromide emulsion (average grain size: 0.4 μm, average iodine content: 8.0 mol %) | 0.6 g |
| Silver iodobromide emulsion (average grain size: 0.3 μm, average iodine content: 2.0 mol %) | 0.2 g |
| Sensitizing dye (S-4) | $6.7 \times 10^{-4}$ mol per mol silver |
| Sensitizing dye (S-5) | $0.8 \times 10^{-4}$ mol per mol silver |
| Magenta coupler (M-1) | 0.17 g |
| Magenta coupler (M-2) | 0.43 g |
| Colored agenta coupler (CM-1) | 0.10 g |
| DIR compound (D-3) | 0.02 g |
| High-boiling solvent (Oil-2) | 0.7 g |
| Gelatin | 1.0 g |
| 7th layer: High-speed green-sensitive emulsion layer (G-H) | |
| Silver iodobromide emulsion (average grain size: 0.7 μm, average iodine content: 7.5 mol %) | 0.9 g |
| Sensitizing dye (S-6) | $1.1 \times 10^{-4}$ mol per mol silver |
| Sensitizing dye (S-7) | $2.0 \times 10^{-4}$ mol per mol silver |
| Sensitizing dye (S-8) | $0.3 \times 10^{-4}$ mol per mol silver |
| Magenta coupler (M-1) | 0.30 g |
| Magenta coupler (M-2) | 0.13 g |
| Colored magenta coupler (CM-1) | 0.04 g |
| DIR compound (D-3) | 0.004 g |
| High-boiling solvent (Oil-2) | 0.35 g |
| Gelatin | 1.0 g |
| 8th layer: Yellow filter layer (YC) | |
| Yellow colloidal layer | 0.1 g |
| Additive (HS-1) | 0.07 g |
| Additive (HS-2) | 0.07 g |
| Additive (SC-1) | 0.12 g |

-continued

| | |
|---|---|
| High-boiling solvent (Oil-2) | 0.15 g |
| Gelatin | 1.0 g |
| 9th layer: Low-speed blue-sensitive emulsion layer (B-L) | |
| Silver iodobromide emulsion (average grain size: 0.3 μm, average iodine content: 2.0 mol %) | 0.25 g |
| Silver iodobromide emulsion (average grain size: 0.4 μm, average iodine content: 8.0 mol %) | 0.25 g |
| Sensitizing dye (S-9) | $5.8 \times 10^{-4}$ mol/mol silver |
| Yellow coupler (Y-1) | 0.6 g |
| Yellow coupler (Y-2) | 0.32 g |
| DIR compound (D-1) | 0.003 g |
| DIR compound (D-2) | 0.006 g |
| Gelatin | 1.3 g |
| 10th layer: High-speed blue-sensitive emulsion layer (B-H) | |
| Silver iodobromide emulsion average iodine content: 8.5 mol %) | 0.5 g |
| Sensitizing dye (S-10) | $3 \times 10^{-4}$ mol/mol silver |
| Sensitizing dye (S-11) | $1.2 \times 10^{-4}$ mol/mol silver |
| Yellow coupler (Y-1) | 0.18 g |
| Yellow coupler (Y-2) | 0.10 g |
| High-boiling solvent (Oil-2) | 0.05 g |
| Gelatin | 1.0 g |
| 11th layer: 1st protective layer (PRO-1) | |
| Silver iodobromide emulsion (average grain size: 0.08 μm) | 0.3 g |
| UV absorber (UV-1) | 0.07 g |
| UV absorber (UV-2) | 0.10 g |
| Additive (HS-1) | 0.2 g |
| Additive (HS-2) | 0.1 g |
| High-boiling solvent (Oil-1) | 0.07 g |
| High-boiling solvent (Oil-3) | 0.07 g |
| Gelatin | 0.8 g |
| 12th layer: 2nd protective layer (PRO-2) | |
| Compound A | 0.04 g |
| Compound B | 0.004 g |
| Polymethyl methacrylate (average grain size: 3 μm) | 0.02 g |
| Copolymer of methyl methacrylate, ethyl methacrylate and methacrylic acid (molar ratio: 3:3:4, average grain size: 3 μm) | 0.13 g |

The silver iodobromide emulsion employed in the 10th layer was prepare by the double-jet method using monodispersed silver iodobromide grains (silver iodide content: 2 mol%) as seed grains.

To solution G-1 that has been kept at 70° C., pAg 7.8 and pH 7.0, 0.34 mol-equivalent amount of the seed grains was added with stirring.

Then, solutions H-1 and S-1 were added over a period of 86 minutes at accelerated flow rates such that the flow rates immediately before the completion of addition would be 3.6 times as high as those immediately after the start of addition. The ratio of the flow rate of solution H-1 to that of solution S-1 was kept at 1:1, thereby an internal, a high iodine content layer (core) was formed.

While keeping pAg and pH at 10.1 and 6.0, respectively, solutions H-2 and S-2 were added over a period of 65 minutes at accelerated flow rates such that the flow rates immediately before the completion of addition would be 5.2 times as high as those immediately after the start of addition. The ratio of the flow rate of solution H-2 to that of solution S-2 was kept at 1:1, thereby an external, a low iodine content layer (shell) was formed.

During the growth of silver halide grains, pAg and pH were controlled with an aqueous solution of potassium bromide and a 56% aqueous solution of acetic acid. The formed grains were washed with water by the conventional flocculation method, and then redispersed by the addition of gelatin. pH and pAg were adjusted to 5.8 and 8.06, respectively, at 4-° C.

As a result, there was obtained an emulsion consisting of monodispersed octahedral silver iodobromide grains with an average grain size of 0.80 μm, a variation coefficient of 12.4%, and a silver iodide content of 8.5 mol%.

| | |
|---|---|
| (G-1) | |
| Ossein gelatin | 100.0 g |
| Compound-1 | 25.0 ml |
| 28% aqueous ammonia solution | 440.0 ml |
| 56% aqueous acetic acid solution | 660.0 ml |
| Water was added to make the total quantity | 5000.0 ml. |
| (H-1) | |
| Ossein gelatin | 82.4 g |
| Potassium bromide | 151.6 g |
| Potassium iodide | 90.6 g |
| Water was added to make the total quantity | 1030.5 ml. |
| (S-1) | |
| Silver nitrate | 309.2 g |
| 28% aqueous ammonia solution | Equivalent amount |
| Water was added to make the total quantity | 1030.5 ml. |
| (H-1) | |
| Ossein gelatin | 302.1 g |
| Potassium bromide | 770.0 g |
| Potassium iodide | 33.2 g |
| Water was added to make the total quantity | 3776.8 ml. |
| (S-2) | |
| Silver nitrate | 1133.0 g |
| 28% aqueous ammonia solution | Equivalent amount |

Water was added to make the total quantity 3776.8 ml.

Emulsions for the remaining emulsion layers were prepared in substantially the same manner as mentioned above, except that the average grain size of the seed grains, temperature, pAg, pH, flow rate, addition time and halide composition were changed. The resulting emulsions, each being a core/shell type monodispersed emulsion with a variation coefficient of 20% or less, were different from the above emulsion in average grain size and silver iodide content. Each of the so-obtained emulsions was subjected to chemical ripening to an optimum level in the presence of sodium thiosulfate, chloroauric acid and ammonium thiocyanate, and then subjected to spectral sensitization with sensitizing dyes, 4-hydroxy-6-methyl-1,3,3a,7-tetrazaindene and 1-phenyl-5-mercaptotetrazole.

Sample 101 further contained compounds Su-1 and Su-2, a viscosity controller, a hardener shown in Table 1, stabilizer ST-1, antifoggants AF-1 and AF-2 (two kinds of AF-2 were employed. One had a weight-average molecular weight of 10,000 and the other 1,100,000.), dyes AI-1 and AI-2 and compound DI-1 (9.4 mg/m$^2$). The structures of the compounds employed in the photographic component layers are shown below.

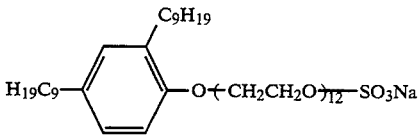

(C-6)

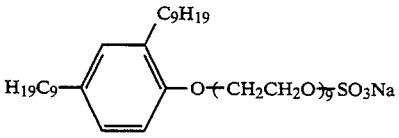

(C-7)

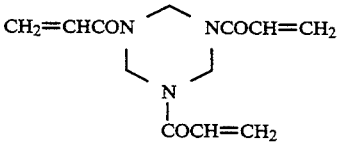

(C-8)

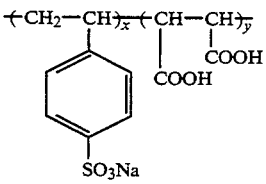

$\overline{Mn}$ = 5000 x:y = 75:25 (Weight ratio)

(C-9)

$\overline{Mn}$ = Number average molecular weight

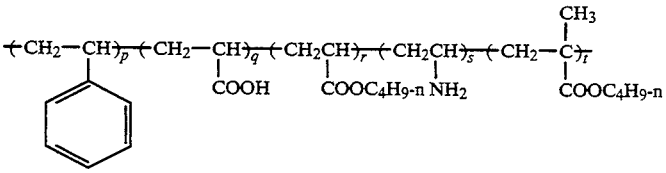

p:p:r:s:t = 40:5:10:5:40 (Weight ratio)

(C-11)

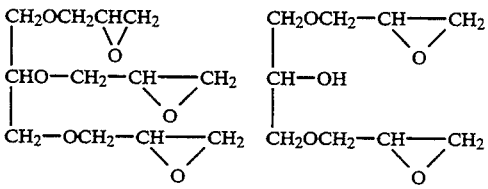

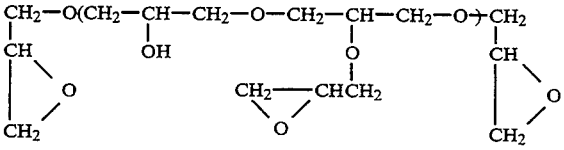

A mixture of the following three ingredients

-continued
C-1
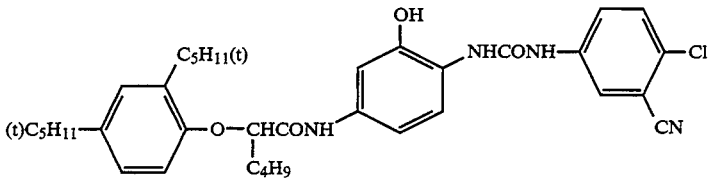
C-2
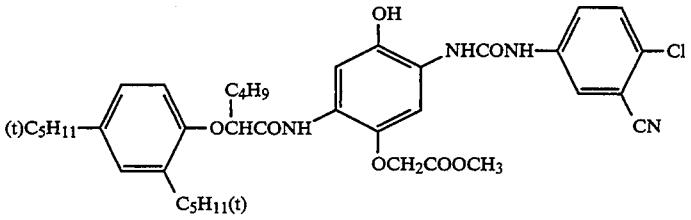
M-1
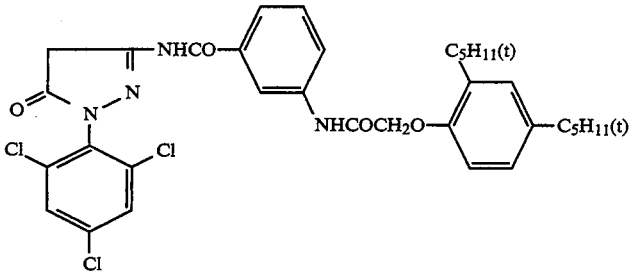
M-2
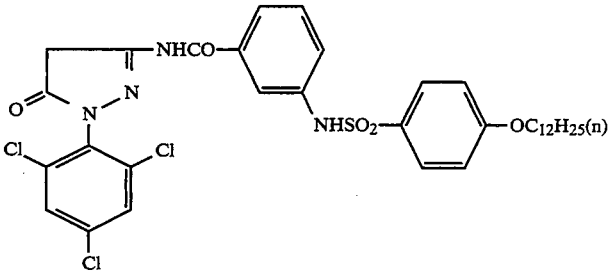
Y-1
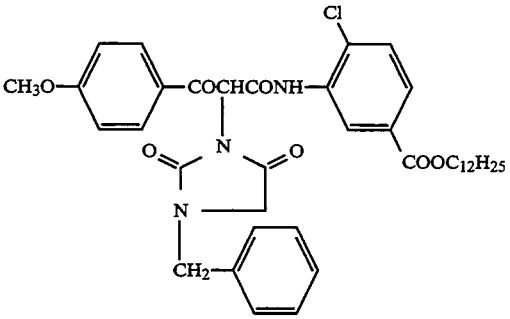
Y-2
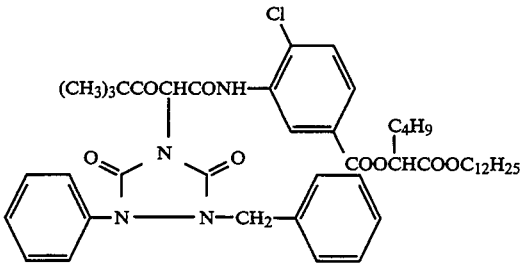

-continued
CC-1
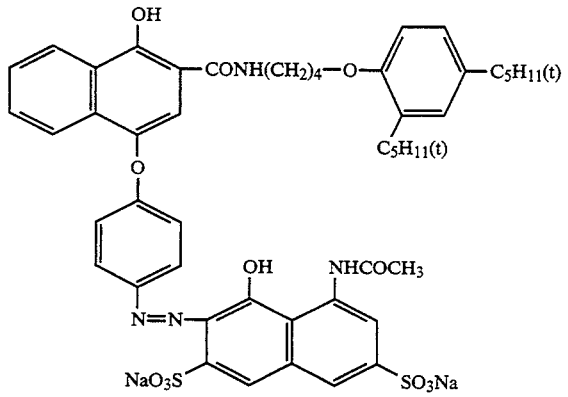
CM-1
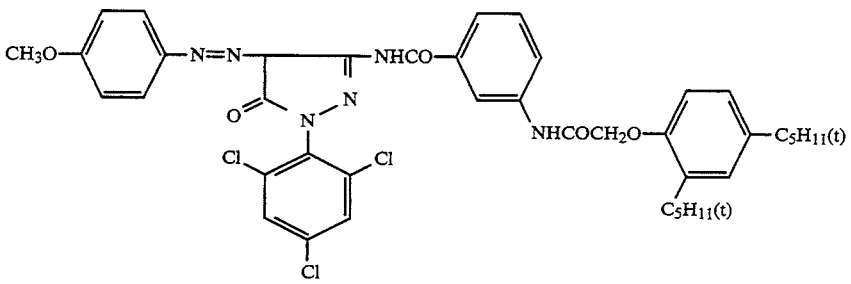
D-1
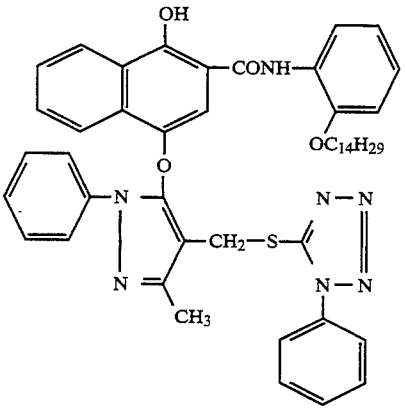
D-2
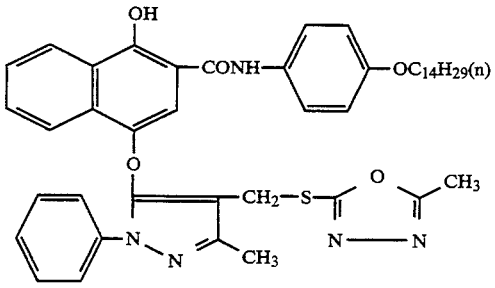

-continued
D-3
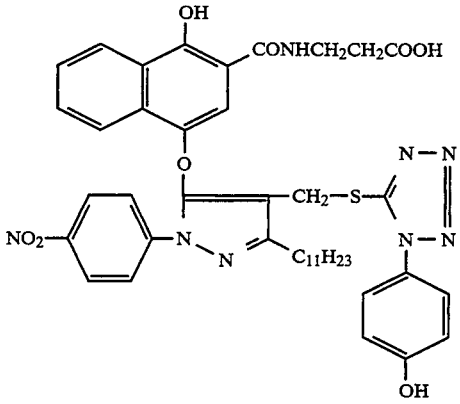
UV-1
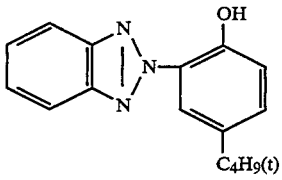
UV-2
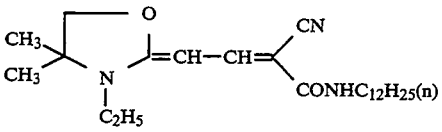
S-1
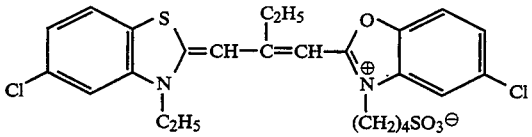
S-2
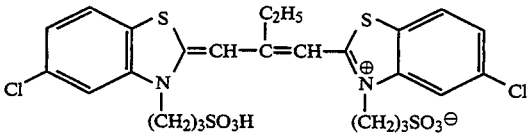
S-3
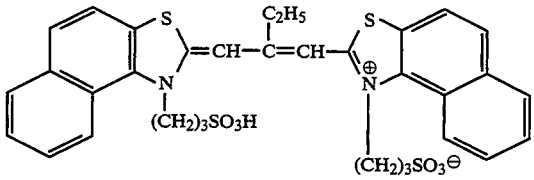
S-4
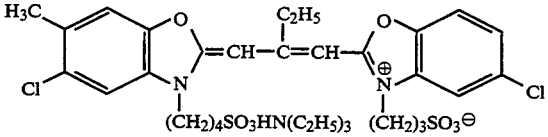
S-5
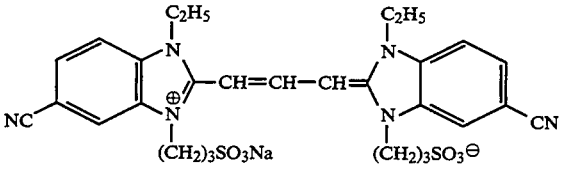

-continued
S-6
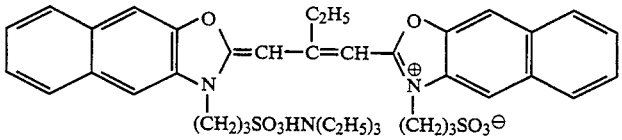
S-7
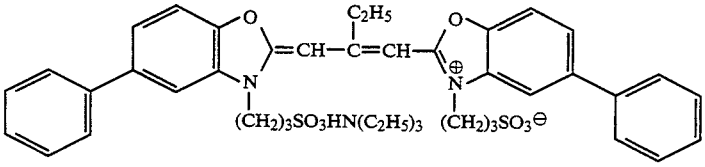
S-8
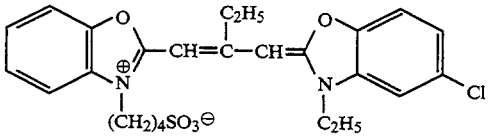
S-9
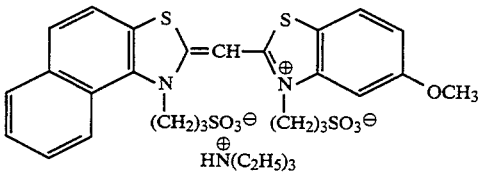
S-10
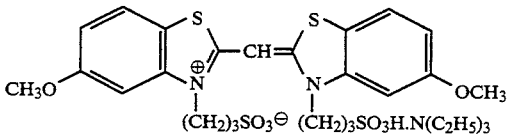
S-11
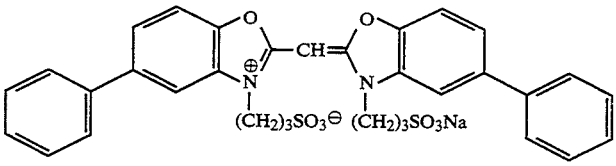
HS-1
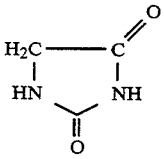
HS-2
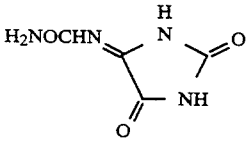
SC-1
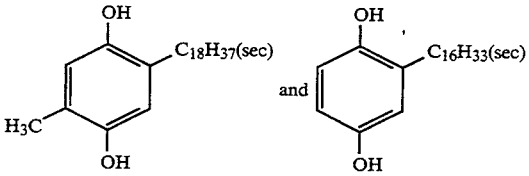
A mixture with a mixing ratio of 2:3
Oil-1
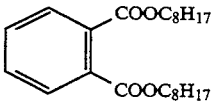

-continued
Oil-2
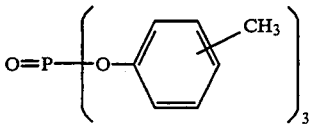
Oil-3
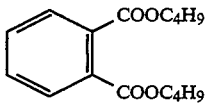
H-1
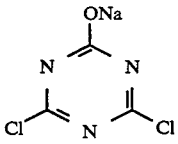
H-2
$(CH_2{=}CHSO_2CH_2)_2O$
Su-1
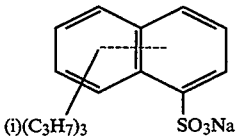
Su-2
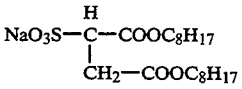
Compound A
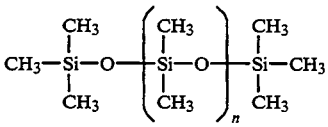
Weight average molecular weight = 30,000
Compound B
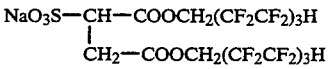
(a mixture of the following three ingredients)
DI-1
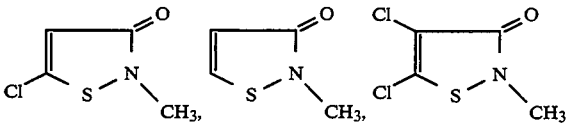
Ingredient A Ingredient B Ingredient C
Ingredient A:Ingredient B:Ingredient C = 50:45:4 (molar ratio)
AI-1
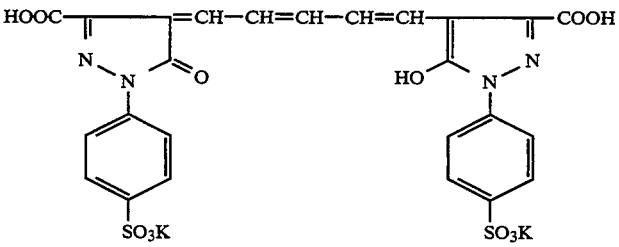

-continued

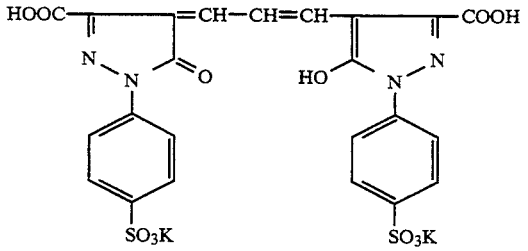

AI-2

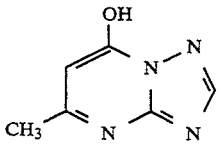

ST-1

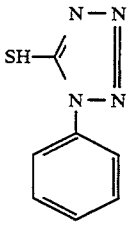

AF-1

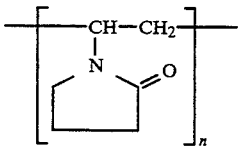

AF-2

Sample Nos. 102 to 109 were prepared in substantially the same manner as in the preparation of Sample No. 101, except that supports 2, 3 and 4 were used instead of support 1, and the gelatin contents of the back coating layer and the emulsion layer were varied to shown in Table 1. Each of sample Nos. 105, 106, 108 and 109 had a smaller emulsion layer gelatin content than sample No. 101. In these samples, the amount of gelatin was reduced equally among the emulsion layers.

(Evaluation)

Each sample was evaluated for the degree of curling, camera loading suitability and capability of being straightened out readily when unrolled.

Degree of curling:

Each sample was cut into a piece of 35 nun in length and 1 mm in width, and left at a relative humidity of 20% for more than 24 hours. The degree of curling was then measured.

Camera loading suitability:

Each sample, that had been put in a cartridge, was loaded in a camera (auto loading type) and examined whether it could be wound on the spool smoothly.

A: No troubles

B: Troubles occurred

Capability of being straightened out

Each sample (12 cm×35 cm) was wound on a reel (diameter: 10 ram) and left at 60° C. and 30%RH for 12 hours. Then, each sample was removed from the reel, immersed in 40° C. distilled water for 15 minutes, followed by the application of a load of 50 g. After drying in a thermostatic air chamber of 55° C. for 3 minutes, each sample was hung down perpendicularly for the measurement of the length. This length was compared with the initial length .

TABLE 1

| Sample No. | Comparison/ Invention | Support No | Support tan δ | Gelatin content: Back coating layer | Gelatin content: Gelatin content ratio: Back coating layer/Emulsion layer |
|---|---|---|---|---|---|
| Sample 101 | Comparative example | 1 | 0.016 | 4 g/m$^2$ | 0.25 |
| Sample 102 | | 2 | 0.014 | 4 g/m$^2$ | 0.25 |
| Sample 103 | | 3 | 0.052 | 4 g/m$^2$ | 0.25 |
| Sample 104 | Present invention | 3 | 0.052 | 5 g/m$^2$ | 0.31 |
| Sample 105 | | 3 | 0.052 | 4 g/m$^2$ | 0.33 |
| Sample 106 | | 3 | 0.052 | 5 g/m$^2$ | 0.42 |
| Sample 107 | | 4 | 0.042 | 5 g/m$^2$ | 0.31 |
| Sample 108 | | 4 | 0.042 | 4 g/m$^2$ | 0.33 |
| Sample 109 | | 4 | 0.042 | 5 g/m$^2$ | 0.42 |

TABLE 2

| Sample No. | Comparison/ Invention | Degree of curling (20% RH) | Camera loading suitability | Capability of being straightened out |
|---|---|---|---|---|
| Sample 101 | Comparative example | 15 | A | 15% |
| Sample 102 | | 15 | A | 25% |
| Sample 103 | | 25 | B | 100% |
| Sample 104 | Present invention | 15 | A | 100% |
| Sample 105 | | 15 | A | 100% |
| Sample 106 | | 10 | A | 100% |
| Sample 107 | | 15 | A | 100% |
| Sample 108 | | 15 | A | 100% |
| Sample 109 | | 10 | A | 100% |

As is evident from Table 1, the samples of the invention (in which the support had a los modulus (at 50° C.)

of 0.03 or more, the back coating layer had a gelatin content of 6 g/m$^2$ or less, and the ratio of the gelatin content of the back coating layer to that of the emulsion layer was 0.3 or more) could e readily straightened out when unrolled, hardly took a curl at a low humidity, and hence, were improved in camera loading suitability. In the case of the comparative samples in which the support had a loss modulus of 0.03 or less and the ratio of the gelatin content of the back coating layer to that of the emulsion layer was 0.3 or less, they could not be straightened out readily when unrolled, though being improved in camera loading suitability. The samples of the invention exhibited excellent resistance to curling and camera loading suitability even with such a small thickness as 75 μm. As mentioned above, a thin light-sensitive material has such a merit that a small roll of film with a large number of exposures can be prepared therefrom.

By the present invention, it is possible to provide a silver halide photographic light-sensitive material which is tough and thin, and hence, can realize a large number of exposures with a compact camera. The light-sensitive material of the invention can be straightened out readily when unrolled, and is improved in camera loading suitability due to its higher resistance to curling.

What is claimed is:

1. A rolled silver halide photographic light-sensitive material for color film, comprising:

a support formed of a copolyester comprising an aromatic dibasic acid containing a metal salt of sulfonic acid, and a glycol, at least one silver halide emulsion layer provided on a first side of said support, and a back coating layer provided on a second side of said support, wherein said support as a loss modulus tan δ of 0.03 or more at 50° C.;

said back coating layer having a gelatin content of 6 g/m$^2$ or less; and a ratio of a gelatin content of said back coating layer to that of said silver halide emulsion layer being 0.3 or more.

2. The material of claim 1 wherein the copolyester comprises a polyester of terephthalic acid and the glycol.

3. The material of claim 1 wherein the copolyester comprises an aromatic dicarboxylic acid containing a metal salt of sulfonic acid and a polyethylene glycol.

4. The material of claim 3 wherein the aromatic dicarboxylic acid containing the metal salt of sulfonic acid is selected from the group consisting of 5-sodium sulfoisophthalate, 2-sodium sulfoterephthalate, 6-naphthalene dicarboxylate and compounds obtained by substituting the sodium of the preceding compounds with potassium or lithium.

5. The material of claim 4 wherein the aromatic dicarboxylic acid containing the metal salt of sulfonic acid is 5-sodium sulfoisophthalate.

6. The material of claim 3 wherein the copolyester is a copolymer of the polyester of terephthalic acid and glycol, and a polymer of 5-sodium sulfoisophthalate and the polyethylene glycol.

7. The material of claim 6 wherein the polyethylene glycol has a 2 to 500 ethylene glycol repeating units.

8. The material of claim 7 wherein the polyethylene glycol has the 50 to 150 ethylene glycol repeating units.

9. The film of claim 1 wherein the loss modulus tan δ is within a range of 0.03 to 0.52.

10. The film of claim 1 having a thickness of not less than 75 μm.

11. The film of claim 1 wherein the ratio of the gelatin content of said back coating layer to that of said silver halide emulsion layer is within a range of 0.3 to 0.42.

* * * * *